US006676215B1

(12) United States Patent
Shah et al.

(10) Patent No.: US 6,676,215 B1
(45) **Date of Patent: *Jan. 13, 2004**

(54) PRESSURE-RELIEVING WHEELCHAIR SEATING APPARATUS

(75) Inventors: Mehendra C. Shah, East Northport, NY (US); Arthur A. Ezra, Huntington Station, NY (US)

(73) Assignee: The Research Foundation of State University of New York, Albany, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/419,434

(22) Filed: Apr. 21, 2003

Related U.S. Application Data

(63) Continuation of application No. 09/829,390, filed on Apr. 9, 2001, now Pat. No. 6,557,937.

(51) Int. Cl.[7] ..... A47C 3/025

(52) U.S. Cl. ..... 297/284.3; 297/452.63; 5/933

(58) Field of Search ..... 297/284.3, 452.63; 5/933, 934

(56) References Cited

U.S. PATENT DOCUMENTS 2,445,158 A * 7/1948 Sparhawk ..... 5/611
3,298,363 A * 1/1967 Parkin ..... 601/103
3,656,190 A * 4/1972 Regan et al. ..... 5/613
4,494,260 A * 1/1985 Olds et al. ..... 5/613
4,628,555 A * 12/1986 Forster ..... 5/247
5,626,555 A * 5/1997 Di Blasi et al. ..... 601/98
6,557,937 B1 * 5/2003 Shah et al. ..... 297/284.3

FOREIGN PATENT DOCUMENTS

FR 2645014 A1 * 10/1990 ..... A61G/7/057
GB 2077580 A * 12/1981 ..... A61G/7/00

* cited by examiner

*Primary Examiner*—Peter M. Cuomo
*Assistant Examiner*—Stephanie Harris
(74) *Attorney, Agent, or Firm*—Hoffmann & Baron, LLP

(57) ABSTRACT

A seating apparatus for supporting a lower body region of an immobilized person for avoidance and relief of decubitus ulcers which provides regular intervals of seating pressure reduction below a predetermined seating pressure for a predetermined relief period. The seating apparatus includes a plurality of slats/cushions which may be displaced between a first support position wherein each of the slats/cushions is co-planar with a defined plane and a second displaced position wherein each of the slats/cushions is displaced a distance D from the defined plane for the predetermined relief period whereby capillary blood pressure is reduced below the predetermined seating pressure in the unsupported portion of the lower body region.

19 Claims, 6 Drawing Sheets

PRESSURE-RELIEVING WHEELCHAIR SEATING APPARATUS

This application is continuation of Ser. No. 09/829,390 filed Apr. 9, 2001, now U.S. Pat. No. 6,557,937.

BACKGROUND OF THE INVENTION

The present invention relates to a seating apparatus and, more particularly, to a pressure-relieving wheelchair seating apparatus for avoidance and relief of decubitus ulcers (i.e., pressure sores).

Decubitus ulcers develop on the skin of immobilized people, particularly under bony locations like the ischial tuberosities and coccyx, when the seating pressure exceeds a typical value of 32 mm Hg for a period of time, such pressure stopping blood flow to the tissues under pressure. While other factors such as diet, moisture, and shear stress on the skin contribute to the formation of decubitus ulcers, they can generally be avoided by physically moving the immobilized person at frequent intervals to restore blood flow to the pressurized areas.

The medical industry has recognized that a general relationship exists between seating pressure and seating time. That is, the greater the seating pressure, the less time a person may sit in that same position without suffering damage to the skin and tissue located at that position. Although each person exhibits a different pressure/time relationship (based on such factors as body weight, shape and structure), a general relationship was established by J. B. Reswick and J. E. Rogers which plots the maximum suggested seating pressure vs. the maximum suggested seating time for tissue under a bony location. This relationship is commonly referred to as the Reswick/Rogers curve, and provides general seating guidelines for an average person. For example, the Reswick/Rogers curve provides that a seating pressure of 500 mm Hg will allow the immobilized person to remain seated for approximately 1.1 hours, while a seating pressure of 200 mm. H.g. will allow the immobilized person to remain seated for approximately 2 hours.

As mentioned, the seating pressure under a bony location, such as the ischial tuberosities, varies from person to person based on body weight, shape and structure. However, average seating pressures typically range from about 200 mm Hg to about 500 mm Hg. These seating pressures therefore limit the seating time to relatively short periods (i.e., 1.1 hours to 2 hours as defined by the Reswick/Rogers curve) before movement of the immobilized person is necessitated. Of course, the immobilized person can usually not move himself or herself, and must rely upon the assistance of another person.

It will be appreciated by one skilled in the medical art that typical blood pressure in the capillaries is about 32 mm Hg (0.62 psi). As a result, a seating pressure above 32 mm Hg restricts and/or obstructs blood flow in the capillaries experiencing this pressure, thus preventing blood flow to the surrounding tissues. A prolonged period of restricted and/or obstructed blood flow leads to tissue damage, and eventually to the development of a decubitus ulcer. The medical art has therefore recognized that periodic pressure relief is required (particularly a reduction in pressure below 32 mm Hg for at least five seconds thereby reestablishing capillary blood flow) with respect to body tissue experiencing pressure (e.g., seating pressure) above 32 mm Hg. However, although this requirement has been recognized by the medical art, no prior art device has been able to satisfactorily provide the necessary periodic pressure relief required by a seated immobilized person.

In this regard, the prior art has attempted to reduce the frequency of developing decubitus ulcers through the use of various seating cushions for minimizing the seating pressure under the immobilized person. For example, certain prior art cushions are provided with cut-out openings at locations corresponding to the maximum pressure points in an attempt to relieve these local pressure concentrations under the bony locations. However, the surrounding seating pressure can still be high enough to stop the blood supply in the capillaries under these bony areas. Certain other prior art cushions utilize inflatable compartments filled with air or a gel in which the pressure is alternately raised or lowered in different compartments sequentially so that the area of maximum pressure is not always in the same location. However, such prior art inflatable cushions cannot ensure that the seating pressure is adequately reduced when a particular compartment is deflated, since the deflated compartment may still remain in contact with the seated individual.

The prior art has also attempted to reduce the frequency of developing decubitus ulcers through the use of support structures including a plurality of movable elements. For example, U.S. Pat. Nos. 5,626,555 and 5,109,558 disclose support structures including a plurality of movable elements for supporting an immobilized person. The patents teach that prolonged periods of contact with a typical support structure decreases the blood circulation in the person leading to the formation of bed sores. The patents further teach that periodic relief of pressure through movement of the individual elements of the support structure can improve blood circulation and avoid soreness.

These patents, and the prior art in general, fail to recognize the complex relationship that must exist between the various aspects of a support structure for such structure to prevent development (and to actually promote healing) of decubitus ulcers. The factors to be considered include the number of individual support elements, the frequency and length of time of displacement, the sequential direction of displacement, the displacement distance of the support element, the type of cushion material, the thickness and stiffness of the cushion material, and weight, shape and bone structure of the patient, among others. A careful review of the prior art indicates that the disclosed devices fail to recognize this complex relationship and, accordingly, fail to prevent the formation of decubitus ulcers. The prior art devices are also incapable of promoting the healing of such ulcers. Finally, the mentioned prior art devices are also inadequate for retrofitting of existing wheelchairs due to their overall size and space requirements.

No single prior art seating apparatus or cushion simultaneously addresses all of the mentioned problems. There is therefore a need in the art for a seating apparatus which provides periodic pressure relief to the seated immobilized person thereby reducing the seating pressure below 32 mm Hg for at least five (5) seconds to restore and/or promote blood flow in the capillaries, which alternates this periodic pressure relief through different localities, which provides air circulation under the seated person to prevent the build-up of moisture underneath, and which allows the continued use of a wheelchair by a person with an existing decubitus ulcer.

SUMMARY OF THE INVENTION

The present invention, which addresses the needs of the prior art, relates to a seating apparatus for supporting a lower body region of an immobilized person for avoidance and relief of decubitus ulcers. The seating apparatus provides regular intervals of seating pressure reduction below a predetermined seating pressure for at least a predetermined relief period. The seating apparatus includes a plurality of rigid slats. The slats define a support plane for supporting the lower body region of the immobilized person. Each of the slats is movable between a first support position wherein each of the slats is coplanar with the support plane and a second displaced position wherein each of the slats is displaced a distance D from the support plane for the predetermined relief period whereby capillary blood pressure is reduced below the predetermined seating pressure in the unsupported portion of the lower body region. Each of the slats supports a cushion for sitting thereon, the cushion being formed from a viscoelastic material. The seating apparatus further includes a cage for supporting the slats and which is configured to allow movement of each of the slats between the first and second position. The seating apparatus further includes a plurality of mechanisms for moving each of the slats between the first and second positions. The seating apparatus further includes a controller for regulating movement of each of the slats between the first and second positions in accordance with a predetermined program. The cushion has a thickness T, a stiffness S, a maximum compression C and a recovery rate R. The thickness T and stiffness S are selected to allow the cushion to conform to the lower body region of the immobilized person to provide support therefor while minimizing an initial seating pressure $P_i$. The displacement D exceeds the maximum compression C. The maximum compression C is a function of thickness T, stiffness S and body weight of the immobilized person. Finally, the recovery rate R of the cushion is no greater than the predetermined relief period.

The present invention is further directed to a seating apparatus for supporting a lower body region of an immobilized person for avoidance and relief of decubitus ulcers. The seating apparatus provides regular intervals of seating pressure reduction below a predetermined seating pressure for at least a predetermined relief period and is sized and configured to retrofit an existing seat of a wheelchair. The seating apparatus includes a plurality of rigid slats having opposing ends. The slats define a support plane for supporting the lower body region of the immobilized person Each of the slats is movable between a first support position wherein each of the slats is coplanar with the support plane and a second displaced position wherein each of the slats is displaced a distance D from said support plane for the predetermined relief period whereby capillary blood pressure is reduced below the predetermined seating pressure in the unsupported portion of the lower body region. The seating apparatus further includes a generally-rectangular shaped cage having opposing sides. The cage includes a plurality of bearings located along the sides thereof. The seating apparatus further includes a plurality of mechanisms each associated with one of the slats for supporting the slats and for moving each of the slats between the first and second position. Each of the mechanisms includes a pair of support members each having first and second ends. The first ends of the support members are secured to the opposing ends of the slats. The second ends of the support members are slidably engagable with at least one of the bearings whereby each of the slats is supported by the cage. Each of the mechanisms also includes a pair of collars, each of the support members having one of the collars associated therewith. Each of the collars is fixed to the support member at a location between the first and second ends. Each of the collars includes a horizontally-disposed pin receiving slot. Each of the mechanisms also includes a drive shaft having opposing drive ends, each of the drive ends including a drive disk having a drive pin extending therefrom for engaging the horizontally-disposed slat. The drive shaft is rotatably supported by the cage and extends parallel to the slats. Finally, each of the mechanisms includes a motor operably connected to said drive shaft to impart rotational motion thereto thereby causing movement of the associated slat between the first and second position.

The present invention is also directed to a method of retrofitting a wheelchair. The method includes the steps of removing an existing seat of a wheelchair and providing a seating apparatus. The seating apparatus includes a plurality of rigid slats. The slats define a support plane for supporting the lower body region of the immobilized person. Each of the slats is movable between a first support position wherein each of the slats is coplanar with the support plane and a second displaced position wherein each of the slats is displaced a distance D from the support plane for the predetermined relief period whereby capillary blood pressure is reduced below the predetermined seating pressure in the unsupported portion of the lower body region. Each of the slats supports a cushion for sitting thereon, the cushion being formed from a viscoelastic material. The seating apparatus further includes a cage for supporting the slats and which is configured to allow movement of each of the slats between the first and second position. The seating apparatus further includes a plurality of mechanisms for moving each of the slats between the first and second positions. The seating apparatus further includes a controller for regulating movement of each of the slats between the first and second positions in accordance with a predetermined program. The cushion has a thickness T, a width W, a stiffness S, a maximum compression C and a recovery rate R. The thickness T and stiffness S are selected to allow the cushion to conform to the lower body region of the immobilized person to provide support therefor while minimizing an initial seating pressure $P_i$. The displacement D exceeds the maximum compression C. The maximum compression C is a function of thickness T, stiffness S and the body weight of the immobilized person. The recovery rate R of the cushion is no greater than the predetermined relief period. The method further includes the step of sitting an immobilized person on the seating apparatus and locating a pressure gauge for monitoring seating pressure on the seating apparatus at a position under the ischial tuberosities of the immobilized person. The method includes the further steps of monitoring the seating pressure under the ischial tuberosities and adjusting the stiffness S and thickness T of the cushion to reduce the initial seating pressure $P_i$ while ensuring the displacement D exceeds maximum the compression C whereby the seating pressure is reduced to a pressure below 32 mm Hg during displacement of each of the slats. Finally, the method includes the step of installing the seating apparatus within the existing wheelchair.

Finally, the present invention is directed to a method of treating decubitus ulcers. The method includes the step of providing a chair having a seating apparatus. The seating apparatus includes a plurality of rigid slats. The slats define a support plane for supporting the lower body region of the immobilized person. Each of the slats is movable between a first support position wherein each of the slats is coplanar with the support plane and a second displaced position wherein each of the slats is displaced a distance D from the support plane for the predetermined relief period whereby capillary blood pressure is reduced below the predetermined seating pressure in the unsupported portion of the lower body region. Each of the slats supports a cushion for sitting thereon, the cushion being formed from a viscoelastic material. The seating apparatus further includes a cage for supporting the slats and which is configured to allow movement of each of the slats between the first and second position. The seating apparatus further includes a plurality of mechanisms for moving each of the slats between the first and second positions. The seating apparatus further includes a controller for regulating movement of each of the slats between the first and second positions in accordance with a predetermined program. The cushion has a thickness T, a width W, a stiffness S, a maximum compression C and a recovery rate R. The thickness T and stiffness S are selected to allow the cushion to conform to the lower body region of the immobilized person to provide support therefor while minimizing an initial seating pressure $P_i$. The displacement D exceeds the maximum compression C. The maximum compression C is a function of thickness T, stiffness S and body weight of the immobilized person. The recovery rate R of the cushion is no greater than the predetermined relief period. The seating apparatus has a front side and a back side. The method includes the further step of sitting an immobilized person on the seating apparatus, the person having a decubitus ulcer on a lower body region thereof. The method includes the further step of moving on an individual basis each of the slats from the first position to the second position in a sequential direction extending from the front side to the back side whereby blood flow is stimulated in the lower body region.

As a result, the present invention provides a seating apparatus which provides periodic pressure relief to the seated immobilized person thereby reducing the seating pressure below 32 mm Hg for at least five (5) seconds to restore and/or promote blood flow in the capillaries, which alternates this periodic pressure relief through different localities, which provides air circulation under the seated person to prevent buildup of moisture and which allows the continued use of a wheelchair by a person with an existing decubitus ulcer.

DETAILED DESCRIPTION OF THE INVENTION

Figure 1:
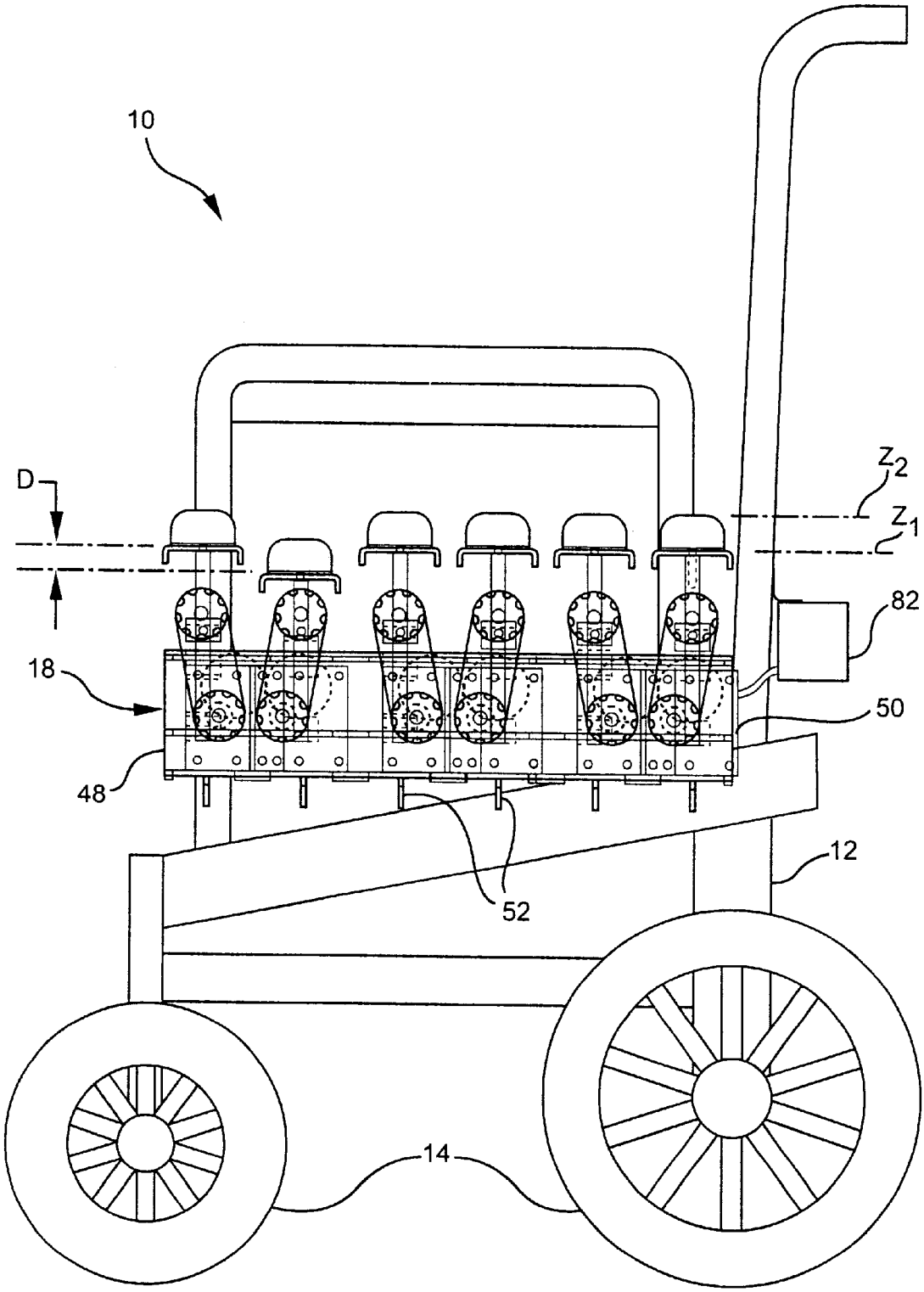
FIG. 1 is a side elevational view, in partial section, of a wheelchair incorporating the seating apparatus of the present invention.
Figure 2:
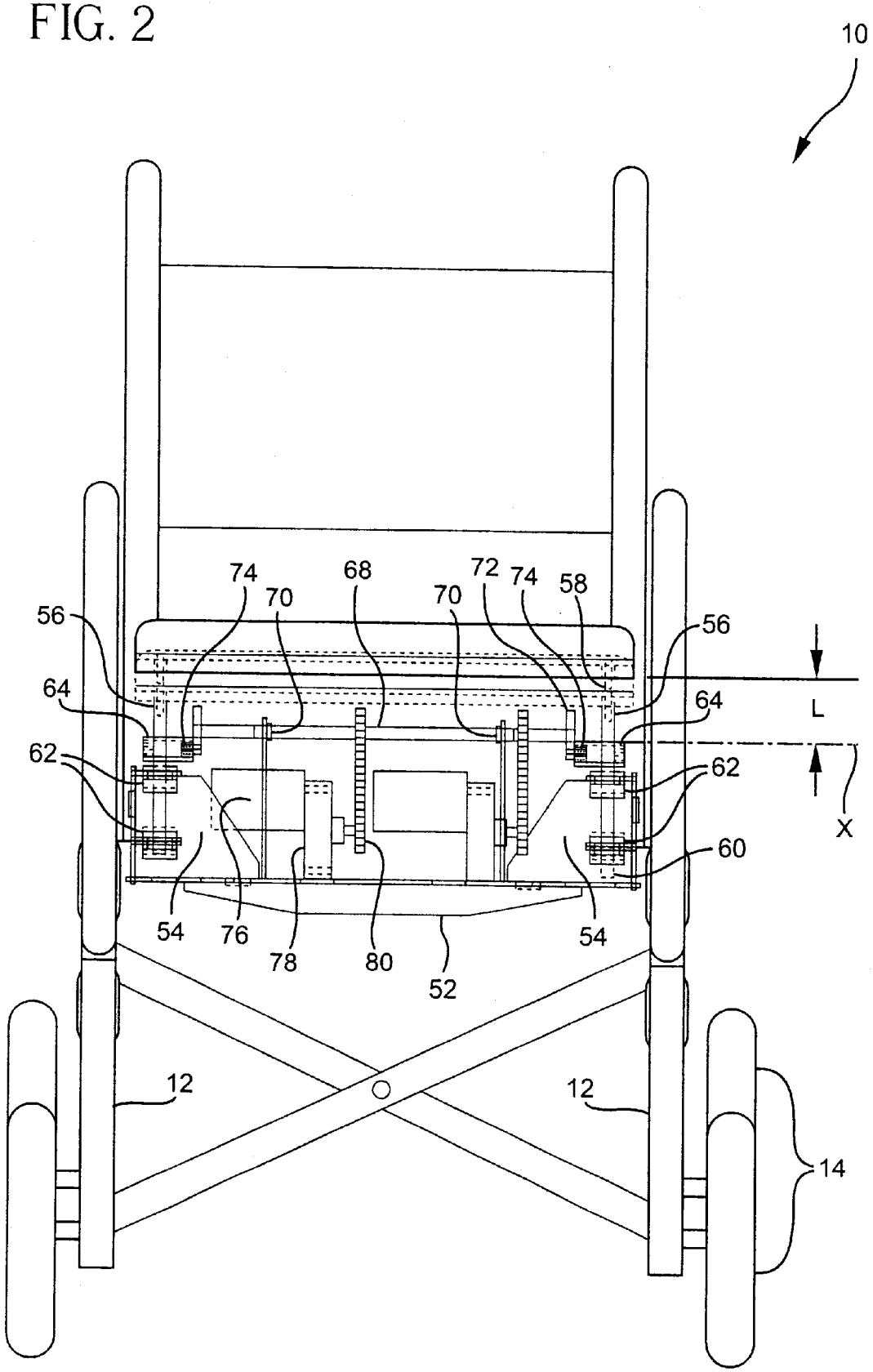
FIG. 2 is a front elevational view, in partial section, of the wheelchair of FIG. 1.

Referring initially to FIGS. 1–2, a wheelchair, designated generally as 10, is shown. Wheelchair 10 includes a frame 12 and a plurality of wheels 14 rotatably secured to the frame for supporting the frame above a floor surface such that the wheelchair can be rolled thereon. An immobilized person (not shown) may be carried by the wheelchair.

Figure 3:
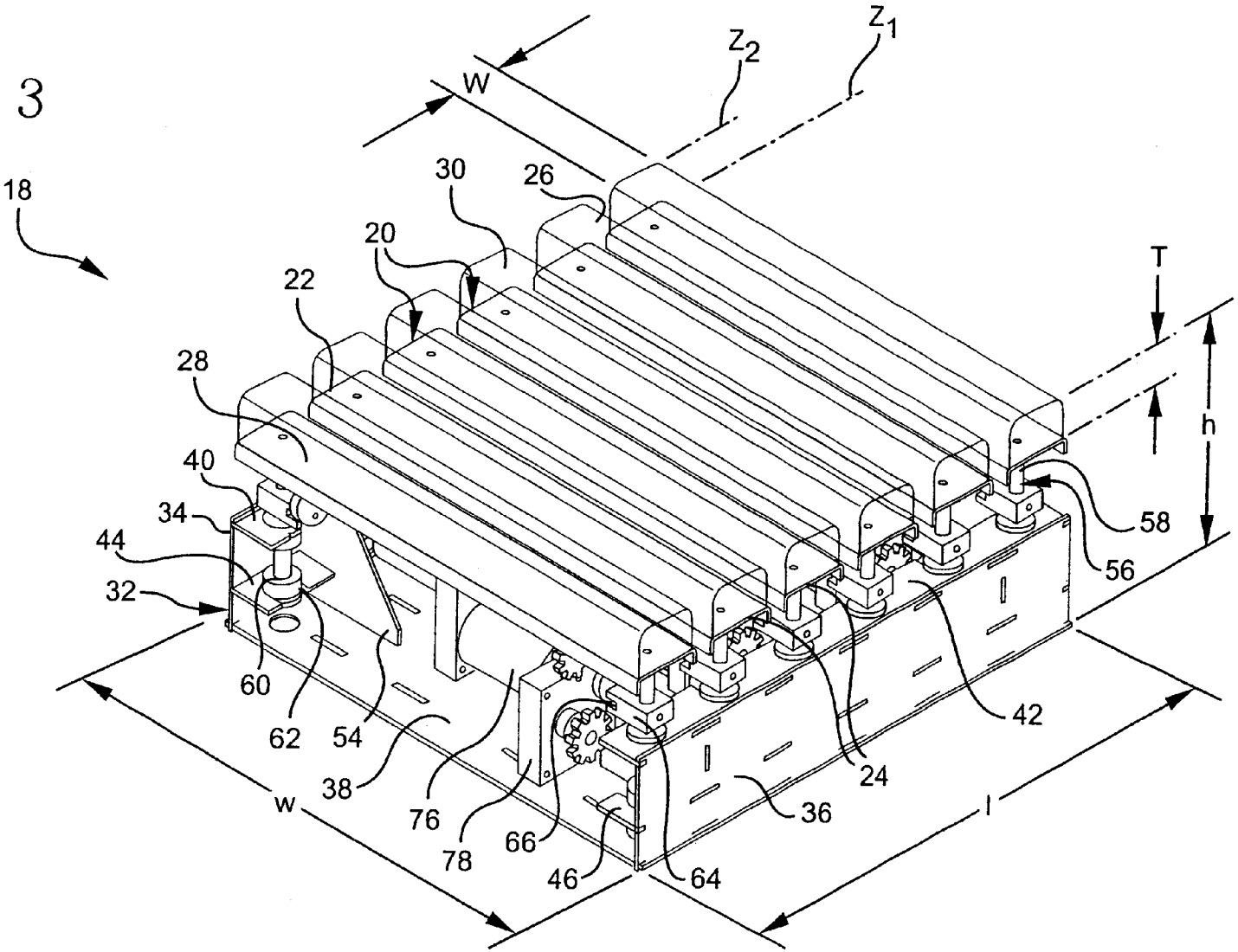
FIG. 3 is an isometric view of the seating apparatus of FIG. 1.

Referring additionally to FIG. 3, the present invention provides a compact, self-contained seating apparatus sized and configured to retrofit an existing wheelchair, i.e., the conventional seat of an existing wheelchair is removed and the present seating apparatus substituted therefor. Seating apparatus 18 includes a plurality of rigid support slats 20 having opposing ends 22, 24. Together, the slats define a support plane $Z_1$, which is oriented generally parallel to the floor surface when the seating apparatus is installed in a wheelchair. Each slat includes a resilient cushion 26 secured to an upper surface 28 of the slat. The upper surfaces 30 of the cushions define a seating plane $Z_2$ generally parallel to support plane $Z_1$ for sitting of the immobilized person thereon. The cushions are preferably secured to the underlying slats in a removable manner, thus allowing ready detachment of the cushion from the slot for cleaning and/or periodic replacement.

Each of the slats may be individually moved between a first support position wherein upper surface 28 of the slat is coplanar with support plane $Z_1$ and a second displaced position wherein the slat is displaced downward toward the floor surface a distance D from support plane $Z_1$ (see FIG. 1). The displacement of a slat to the second displaced position thereby relieves the seating pressure in the portion of the lower body region of the immobilized patient immediately above the displaced slat. Thus, distance D must be sufficient to lower the seating pressure in the portion of the lower body region immediately above the slat below the mentioned pressure level of 32 mm Hg, and preferably to a pressure level of approximately 0 mm Hg. In this regard, the clothing worn by the seated individual should be of light, stretchable fabric to prevent "hammocking" and thus allow the mentioned reduction of seating pressure to take place.

Seating apparatus 18 includes a shallow rectangular cage 32. Cage 32, which forms a rigid support frame for the seating apparatus, includes sidewalls 34, 36 and floor 38. A first pair of upper flanges 40, 42 extend along the upper edges of sidewalls 34, 36, respectively. A second pair of lower flanges 44, 46 extend along the inner surfaces of sidewalls 34, 36 respectively. Cage 32 is sized and configured to allow an existing wheelchair to be retrofit with the present seating apparatus. In this regard, the design of cage 32 must allow it to be fit within and secured to the frame of an existing wheelchair. Accordingly, the overall dimensions of the seating apparatus, are important. In one preferred embodiment, the seating apparatus has a width w of approximately 16" and a length l of approximately 18".

Many existing wheelchairs have limited room under the existing seat, which thereby restricts the overall height h of the apparatus (assuming that seating plane $Z_2$ is to be maintained at approximately the same level as the seating plane of the preexisting seat). It will be appreciated that increasing the height of seating plane $Z_2$ is disadvantageous in that this increases the height of the center of gravity of the person sitting in the chair (potentially decreasing stability of the chair) and would also likely necessitate modification of the arm rests and/or leg rests. As will be discussed further hereinbelow, the compact design of the present seating apparatus, particularly the minimized height dimension h, allows the retrofit of an existing wheelchair to be readily accomplished. Those skilled in the art will recognize that prior art seating apparatuses require significantly more space, especially in the height direction, thereby precluding their use for retrofit existing wheelchairs.

Figure 4:
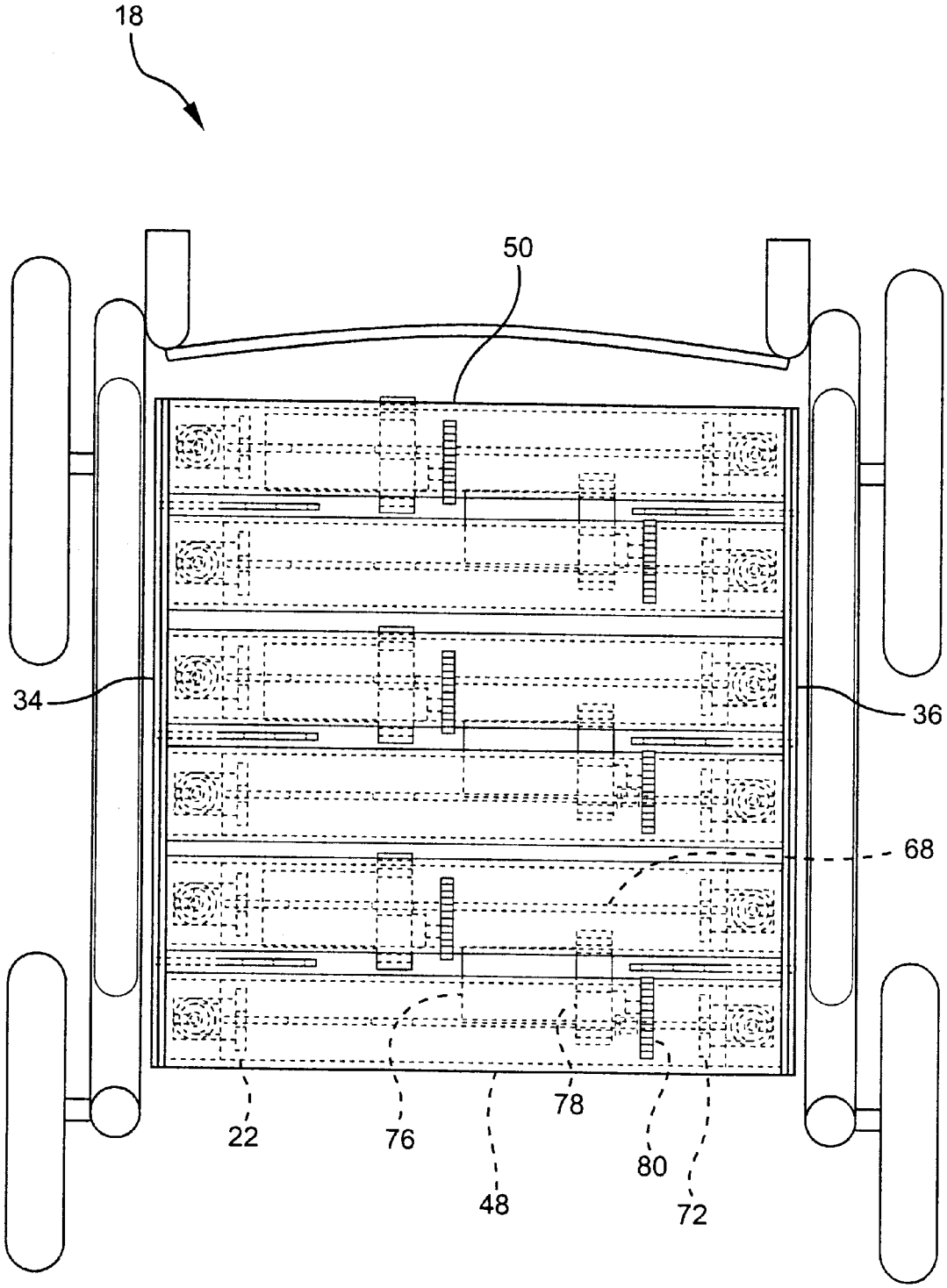
FIG. 4 is a plan view, in partial section, of the seating apparatus/wheelchair arrangement of FIG. 1.

Cage 32 additionally includes front wall 48 and rear wall 50 (see FIGS. 1 and 4). For added stiffness, cage 32 preferably includes a plurality of stiffening ribs 52 welded along the bottom of floor 38, and a plurality of baffles 54 welded between the floor and sidewalls of the cage (see FIGS. 1–2).

The slats are supported at opposing ends 22, 24 by support members 56. Each of these support members includes a slat-supporting end 58 which is secured to the slat, and a cage-engaging end 60. In this regard, cage 32 includes a plurality of bearings 62 which slideably receive the support member, and limit movement of the support member to a direction perpendicular to seating plane $Z_2$. Particularly, each support member engages a set of bearings, one of the bearings being located along the upper flange and the second bearing being located along the lower flange. Thus, as a particular slat is moved between its first and second positions, the members fixed to and supporting the ends of such slat slide up and down (i.e., in a direction perpendicular to seating plane $Z_2$) within the set of bearings. Of course, both the support members 56 and the receiving bearings 62 can take other forms, such as a rectangular support bar/sliding track arrangement, among others.

A collar 64 is fixedly secured to each of the support members, and is located between the upper flange and the respective slat. Each of the collars includes a horizontally-disposed pin receiving slot 66.

Referring now to FIGS. 2 and 4, a drive shaft 68 is associated with each slat. Drive shaft 68 is positioned below the slat, and extends generally parallel thereto. A pair of bearings 70 rotatably supports the shaft with respect to cage 32. A drive plate 72 is connected to each end of drive shaft 68. Each of these drive plates includes a drive pin 74 extending outwardly therefrom in a direction extending towards the sidewalls of the cage, the pin being sized to engage the horizontally-disposed pin receiving slot 66 of collar 64. As a result, rotation of drive shaft 68 causes drive pin 74 to move in a circular direction (as viewed from the sidewall of the cage) thereby causing collar 64 to move therewith. Because of the nature of the engagement between drive pin 74 and collar 64 (i.e., a pin and a horizontally-disposed slot) the movement of collar 64 is limited to movement in a direction perpendicular to seating plane $Z_2$. As a result, rotation of drive shaft 68 results in the vertical displacement of the slat between the first support position wherein the upper surface of the slat is coplanar with support plane $Z_1$ and the second displaced position wherein the slat is displaced downward from support plane $Z_1$ a distance D.

An electric motor 76, a gear box 78 and a drive belt 80 (which provides rotational motion to the drive shaft) are also associated with each slat. The individual drive trains provide a reliable, cost-effective method of moving the slats. In particular, the use of electric motors limits the amount of power used by the seating apparatus, as compared to other power-operated devices such as pneumatic and/or hydraulic actuators. The electric motors are preferably powered by one or more conventional batteries (not shown). Of course, it is contemplated herein that rotational motion may be provided to the drive shaft through other motor/gearing arrangements.

It will be appreciated that the present seating apparatus provides a compact design wherein the height dimension h is minimized. This is accomplished in part through the novel arrangement of the drive shaft, drive plates/pins and collars. Particularly, each of the drive shaft is located along an axis X passing through the center of an imaging circle defined by the rotation of the drive pin associated therewith. As a result, the distance L between the drive shaft and the slat is minimized for a particular displacement distance D. In turn, this minimizes the overall height dimension h of the seating apparatus.

The motors are preferably driven by a controller 82 located on the wheelchair which sequentially powers the individual motors thus resulting in sequential displacement of the individual slats, preferably in a direction from front wall 48 towards rear wall 50. That is, the slat closest to front wall 48 is first displaced between its first and second position, then the second slat is displaced between its first and second position (this second slat is shown in its second displaced position in FIG. 1), and the process repeated until the slat closest to the rear wall 50 is displaced between its first and second positions. The process is continuously repeated, each time starting with the slat closest to front wall 48. The controller is preferably programmed to provide a cycle interval time CI ranging from about 2½ minutes to about 4½ minutes and, most preferably, about 3½ minutes.

It is believed that this sequential displacement of the individual slats provides maximum pressure relief and healing to the immobilized person. Particularly, it is believed that this sequential movement (in addition to accomplishing the required pressure relief in the adjacent tissue), promotes and/or stimulates blood flow through the immobilized person. More particularly, it is believed that this sequential displacement of the slats compensates in part for the lack of skeletal muscles in the immobilized person, which would otherwise facilitate blood flow through the veins and capillaries in this part of the body.

The sequential displacement of the individual slats also limits and/or prevents shearing stresses which might otherwise be imparted to the skin of the immobilized person. In this regard, it is to be appreciated that the design of the present seating apparatus includes a plurality of drive mechanisms which displace the associated slats in a continuous and non-shearing manner. That is, both the initial displacement from the body and the eventual reengagement of the slat with the body is accomplished in a smooth continuous fashion, without any sudden removal of seating support and without any impact/joining upon reengagement. In that the displacement is limited to a direction perpendicular to the seating plane $Z_2$, there are no shearing forces imparted to the lower body region of the immobilized person.

As mentioned, the medical art teaches that the pressure relief must be maintained for a period of time of at least five (5) seconds. It will be appreciated when a particular slat is displaced away from the lower body region of the person that the seating pressure on the adjacent slats necessarily increases because those slats are now carrying additional weight. This increased pressure must be considered in the overall design of the apparatus to ensure that certain accepted seating pressure guidelines are not exceeded. As discussed further hereinbelow, it also limits the minimum number of slats per seating area.

Cushions 26 are preferably formed of a viscoelastic material which allow such cushions to generally conform to the body contour of the immobilized person, thus providing maximum distribution of weight for an overall reduced seating pressure. Each of cushions 26 is preferably secured to the associated slat in a removable fashion, which allows ready replacement of the cushion as required. The choice of a particular viscoelastic material depends upon several factors including the immobilized person's weight, shape and body structure. The cushion must have a stiffness S sufficiently soft to allow such cushion to conform to the buttocks of the immobilized person (this being a function of the person's weight and body shape), but must also have a stiffness S and a thickness T sufficient to ensure that the cushion is not compacted to such an extent that the person's buttocks become pressed against the upper surface of the slat.

As discussed hereinabove, the need to limit the overall height of the seating apparatus requires that the overall displacement distance D be minimized. In turn, the need to minimize displacement distance D increases the importance of properly fitting the cushion to the immobilized person. It will be recognized that the maximum compression C of the cushion is a function of thickness T, stiffness S and the body weight W of the immobilized person. The displacement D must exceed the maximum compression C to ensure that the pressure is relieved from the body portion over the slat. It has been discovered herein that the recovery rate R of the cushion is preferably approximately equal to or less than the relief period (i.e., the time the slat remains out of engagement with the body). As a result, the viscoelastic cushion regains its original shape during the time the slat is displaced downward from support plane $P_1$. The reengagement of the uncompressed cushion with the lower region (e.g., buttocks) of the immobilized person (and resultant compression of such cushion) is believed to provide a massaging effect to the buttocks which stimulate blood flow thereby reducing the tendency to form new ulcers and to heal existing ulcers. The disengagement of the slat/cushion from the lower body region of the immobilized person also allows circulation of air thereabout, which removes moisture from perspiration.

The number of slats together with the cycling frequency of such slats are important design criteria. The seating apparatus of the present invention preferably includes from about five (5) to seven (7) slats for a standard seating area. In a particularly preferred design, the seating apparatus of the present invention includes six (6) support slats. It will be appreciated that a seating apparatus having a fewer number of slats (e.g., four slats) results in a significant (and potentially dangerous) increase in seating pressure as one of such slats is displaced downward. The Reswick/Rogers curve illustrates that such an increased seating pressure significantly reduces the seating time for the person and/or requires a significantly higher cycling frequency of the slats.

The seating apparatus of the present invention preferably has no more than seven slats. It has also been discovered herein that a seating apparatus having too many support slats is disadvantageous. In addition to factors such as increased costs, complexity and weight, the inclusion of too many slats is believed to limit the amount of pressure relief afforded to the lower body region of the immobilized person when such slat is displaced downward. Specifically, the addition of slats for a particular sized seating area translates into a decreased width per slat. As the slats become narrower, there is more of a tendency for the body to "hammock" between adjacent slats thereby preventing an adequate reduction in seating pressure even if the slat positioned thereunder is displaced downward. The inclusion of too many slats in the seating apparatus also increases the cycle interval time (or cycling frequency) because each slat must be displaced for a period of time sufficient to provide at least 5 seconds of pressure relief below 32 mm Hg. Thus, this increased cycle interval time conflicts with the goal of reducing the duration of peak seating pressure experienced by the seated person during displacement of an adjacent slat.

The selection of the cushioning material is preferably based upon the individual person's body weight, shape and structure. This is accomplished via the placement of at least one pressure sensing strip under the seated person, preferably under the ischial tuberosities of the seated person. The initial seating pressure $P_i$ is measured, as is the seating pressure when such slat is displaced. If the seating pressure does not decrease below 32 mm Hg when the slat is displaced, a stiffer cushion is selected. At the same time, if the initial seating pressure $P_i$ is too high, a softer cushioning material is selected. The thickness T of the cushion may also be adjusted, but cannot be increased too much without adversely affecting the seating height in the wheelchair. Accordingly, the proper balance between these various factors ensures a seating apparatus providing maximum comfort, retardation of developments of new ulcers, and healing of old ulcers in a seating apparatus which may be retrofit into the person's existing wheelchair.

The cushion preferably has a thickness T which is equal to or less than the width W (see FIG. 3). This ensures that the cushion properly supports the weight of the immobilized person without twisting and/or toppling during displacement of the slat. In one preferred embodiment, the thickness T of the cushion is from about 1½" to about 2½", and preferably about 2". The displacement D of each slat is preferably from about 1" to about 2" and, more preferably, from about 1¼" to about 1¾".

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendments and or deviations be included within the scope of the following claims.

EXAMPLE

Figure 5:
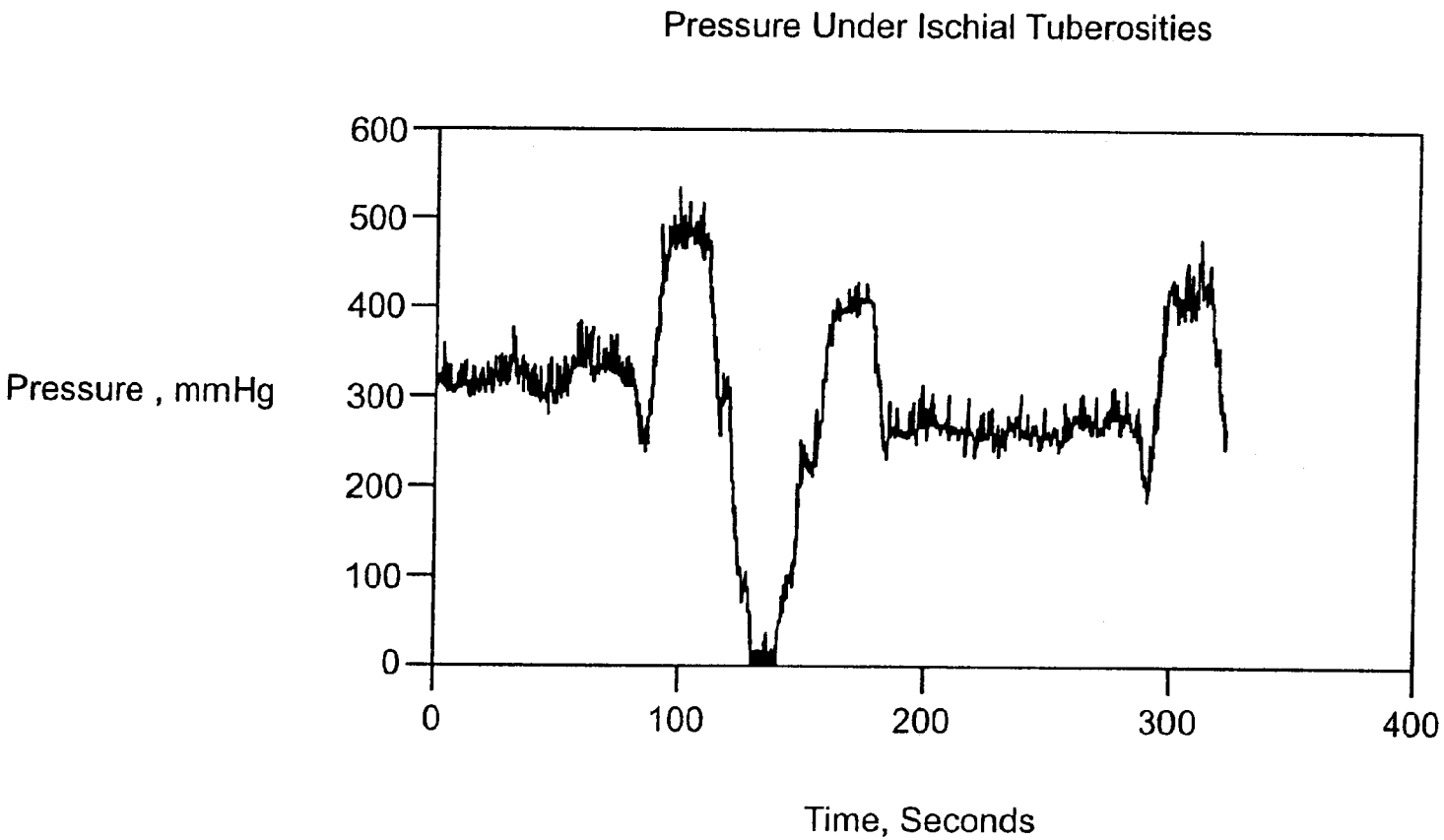
FIG. 5 is a graphical depiction of seating pressure versus time under the ischial tuberosities of a 56 year old male quadriplegic patient weighing approximately 160 lbs.

The seating apparatus of the present invention was retrofit into an existing wheelchair of a 56 year old male quadriplegic patient weighing approximately 160 lbs. FIG. 5 illustrates the seating pressure in millimeters of mercury versus the seating time in seconds for the mentioned patient. The patient exhibited an average seating pressure (during non-displacement of the underlying slat) of approximately 300 mm Hg. As illustrated, the seating pressure under the ischial tuberosities increased when the slats on adjacent sides thereof were displaced. The chart indicates that the seating pressure increased from the original average seating pressure of approximately 300 mm Hg to a peak seating pressure of approximately 400–500 mm Hg. The chart further illustrates that during displacement of the slat under the ischial tuberosities the seating pressure decreased from the original average seating pressure of approximately 300 mm Hg to a seating pressure of approximately 0 mm Hg, and remained below 32 mm Hg for a period exceeding five (5) seconds.

As illustrated, the cycle interval time or cycling frequency (movement of each slat up and down) was approximately 3½ minutes. This cycling frequency corresponded to a pressure relief period for each individual slat of approximately 8½ seconds. The displacement of the slats occurred sequentially from front to back.

Figure 6:
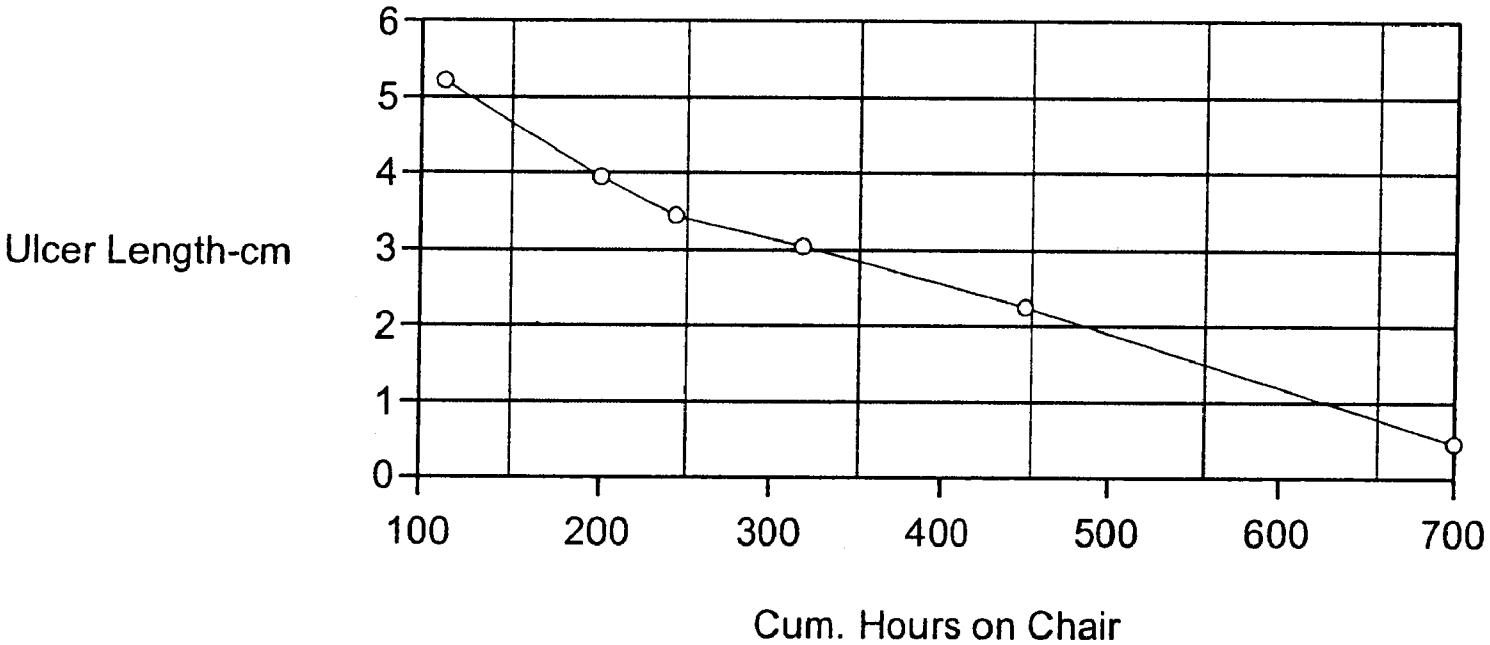
FIG. 6 is a graphical depiction of ulcer length versus cumulative seated hours for the patient of FIG. 5.

The test patient was diabetic, and had pre-existing decubitus ulcers. One of those ulcers was monitored between Aug. 14, 2000 and Dec. 4, 2000. The ulcer, which was several months old as of Aug. 14, 2000, measured 5.3 cm long, 1.6 cm width and 4 cm deep. The cumulative amount of hours in which the patient was seated in the wheelchair (between Aug. 14, 2000 and Dec. 4, 2000) versus the length of the ulcer is depicted in FIG. 6. As of Dec. 4, 2000, the ulcer was fully closed, although the patient still exhibited a sore approximately ½ cm in length.

What is claimed is:

1. A seating apparatus for supporting a lower body region of an immobilized person for avoidance and relief of decubitus ulcers, the seating apparatus providing regular intervals of seating pressure reduction below a predetermined seating pressure for at least a predetermined relief period, comprising:

a plurality of rigid slats, said slats defining a support plane for supporting the lower body region of the immobilized person, each of said slats being movable between a first support position wherein each of said slats is coplanar with said support plane and a second displaced position wherein each of said slats is displaced a distance D from said support plane for the predetermined relief period whereby capillary blood pressure is reduced below the predetermined seating pressure in the unsupported portion of the lower body region, and wherein each of said slats supports a cushion for sitting thereon, said cushion being formed from a viscoelastic material;

a cage for supporting said slats and configured to allow movement of each of said slats between said first and second position;

a plurality of mechanisms for moving each of said slats between said first and second position;

a controller for regulating movement of each of said slats between said first and second position in accordance with a predetermined program;

wherein said cushion has a thickness T, a width W, a stiffness S, a maximum compression C and a recovery rate R, said thickness T and stiffness S being selected to allow said cushion to conform to the lower body region of the immobilized person to provide support therefor while minimizing an initial seating pressure $P_i$, and wherein said displacement D exceeds said maximum compression C, said maximum compression C being a function of thickness T, stiffness S and the body weight of the immobilized person;

and wherein said recovery rate R of said cushion is no greater than said predetermined relief period.

2. The seating apparatus according to claim 1, further comprising a number of slats N wherein N ranges from 5 to 7;

wherein a peak seating pressure $P_p$ is experienced during displacement of one of said slats; and wherein said program provides a cycle interval time CI.

3. The seating apparatus according to claim 2, wherein said cycle interval time CI is selected to maintain said peak seating pressure $P_p$ below accepted pressure guidelines for the selected number of slats N.

4. The seating apparatus according to claim 3, wherein the number of slats N equals 6, and wherein said predetermined seating pressure is approximately 32 mm Hg and said predetermined relief period is at least about 5 seconds.

5. The seating apparatus according to claim 4, wherein said thickness T of said cushion is equal to or less than said width W of said cushion.

6. The seating apparatus according to claim 5, wherein said thickness T of said cushion is approximately 1.5 to about 2.5 inches.

7. The seating apparatus according to claim 3, wherein said cycle interval time CI ranges from about 2½ minutes to about 4½ minutes.

8. The seating apparatus according to claim 1, further comprising a pressure gauge to monitor seating pressure under the lower body region of the person.

9. The seating apparatus accordingly to claim 1, wherein said cage has a front side and a back side; and wherein said program moves each of said slots on an individual basis said first position to said second position in a sequential direction extending from said front side to said back side whereby blood flow is stimulated in said lower body region.

10. A method of retrofitting a wheelchair, comprising the steps of:

removing an existing seat of the wheelchair;

providing a seating apparatus for supporting a lower body region of an immobilized person for avoidance and relief of decubitus ulcers, the seating apparatus providing regular intervals of seating pressure reduction below a predetermined seating pressure for at least a predetermined relief period, said seating apparatus comprising:

a plurality of rigid slats, said slats defining a support plane for supporting the lower body region of the immobilized person, each of said slats being movable between a first support position wherein each of said slats is coplanar with said support plane and a second displaced position wherein each of said slats is displaced a distance D from said support plane for the predetermined relief period whereby capillary blood pressure is reduced below the predetermined seating pressure in the unsupported portion of the lower body region, and wherein each of said slats supports a cushion for sitting thereon, said cushion being formed from a viscoelastic material;

a cage for supporting said slats and configured to allow movement of each of said slats between said first and second position;

a plurality of mechanisms for moving each of said slats between said first and second position;

a controller for regulating movement of each of said slats between said first and second position in accordance with a predetermined program;

wherein said cushion has a thickness T, a width W, a stiffness S, a maximum compression C and a recovery rate R, said thickness T and stiffness S being selected to allow said cushion to conform to the lower body region of the immobilized person to provide support therefor while minimizing an initial seating pressure $P_i$, and wherein said displacement D exceeds said maximum compression C, said maximum compression C being a function of thickness T, stiffness S and the body weight of the immobilized person;

and wherein said recovery rate R of said cushion is no greater than said predetermined relief period;

adjusting said stiffness S and said thickness T of the cushion to reduce the initial seating pressure $P_i$ while ensuring said displacement D exceeds said maximum compression C whereby the seating pressure is reduced to a pressure below 32 mm Hg during displacement of each of said slats; and installing said seating apparatus within the existing wheelchair.

11. The method according to claim 10, further comprising the steps of:

sitting an immobilized person on said seating apparatus;

locating a pressure gauge for monitoring seating pressure on said seating apparatus at a position under the ischial tuberosities of the immobilized person; and monitoring said seating pressure under the ischial tuberosities.

12. A method of treating decubitus ulcers, comprising:

providing a chair having a seating apparatus for supporting a lower body region of an immobilized person for avoidance and relief of decubitus ulcers, the seating apparatus providing regular intervals of seating pressure reduction below a predetermined seating pressure for at least a predetermined relief period, said seating apparatus comprising:

a plurality of rigid slats, said slats defining a support plane for supporting the lower body region of the immobilized person, each of said slats being movable between a first support position wherein each of said slats is coplanar with said support plane and a second displaced position wherein each of said slats is displaced a distance D from said support plane for the predetermined relief period whereby capillary blood pressure is reduced below the predetermined seating pressure in the unsupported portion of the lower body region, and wherein each of said slats supports a cushion for sitting thereon, said cushion being formed from a viscoelastic material;

a cage for supporting said slats and configured to allow movement of each of said slats between said first and second position;

a plurality of mechanisms for moving each of said slats between said first and second position; and a controller for regulating movement of each of said slats between said first and second position in accordance with a predetermined program;

sitting an immobilized person on said seating apparatus, said person having a decubitus ulcer on a lower body region thereof, said seating apparatus having a front side and a back side;

moving on an individual basis each of said slats from said first position to said second position in a sequential direction extending from said front side to said back side whereby blood flow is stimulated in said lower body region.

13. The seating apparatus according to claim 12, further comprising a number of slats N wherein N ranges from 5 to 7;

wherein a peak seating pressure $P_p$ is experienced during displacement of one of said slats; and wherein said program provides a cycle interval time CI.

14. The seating apparatus according to claim 13, wherein said cycle interval time CI is selected to maintain said peak seating pressure $P_p$ below accepted pressure guidelines for the selected number of slats N.

15. The seating apparatus according to claim 14, wherein the number of slats N equals 6, and wherein said predetermined seating pressure is approximately 32 mm Hg and said predetermined relief period is at least about 5 seconds.

16. The seating apparatus according to claim 15, wherein said thickness T of said cushion is equal to or less than said width W of said cushion.

17. The seating apparatus according to claim 16, wherein said thickness T of said cushion is approximately 1.5 to about 2.5 inches.

18. The seating apparatus according to claim 13, wherein said cycle interval time CI ranges from about 2½ minutes to about 4½ minutes.

19. The seating apparatus according to claim 12, wherein said cushion has a thickness T, a width W, a stiffness S, a maximum compression C and a recovery rate R, said thickness T and stiffness S being selected to allow said cushion to conform to the lower body region of the immobilized person to provide support therefor while minimizing an initial seating pressure $P_i$, and wherein said displacement D exceeds said maximum compression C, said maximum compression C being a function of thickness T, stiffness S and the body weight of the immobilized person, said recovery rate R of said cushion being no greater than said predetermined relief period whereby said cushion substantially regains its original shape during said predetermined relief period.

* * * * *